US005528103A

United States Patent [19]

Spindt et al.

[11] Patent Number: 5,528,103

[45] Date of Patent: Jun. 18, 1996

[54] FIELD EMITTER WITH FOCUSING RIDGES SITUATED TO SIDES OF GATE

[75] Inventors: Christopher J. Spindt, Menlo Park; Patrick A. Corcoran, Oakland, both of Calif.

[73] Assignee: Silicon Video Corporation, San Jose, Calif.

[21] Appl. No.: 188,855

[22] Filed: Jan. 31, 1994

[51] Int. Cl.[6] ..... H01J 31/12

[52] U.S. Cl. ..... 313/497; 313/309; 313/310; 313/336; 313/351; 313/422; 313/496

[58] Field of Search ..... 313/309, 310, 313/336, 351, 422, 495, 496, 497, 452; 345/74, 75

[56] References Cited

U.S. PATENT DOCUMENTS

| | | | |
|---|---|---|---|
| 4,008,412 | 2/1977 | Yuito et al. . | |
| 4,020,381 | 4/1977 | Oess et al. . | |
| 4,178,531 | 12/1979 | Alig . | |
| 4,618,801 | 10/1986 | Kakino . | |
| 4,857,799 | 8/1989 | Spindt et al. | 345/74 X |
| 4,874,981 | 10/1989 | Spindt . | |
| 4,884,010 | 11/1989 | Biberian . | |
| 4,983,878 | 1/1991 | Lee et al. . | |
| 5,015,912 | 5/1991 | Spindt et al. . | |
| 5,070,282 | 12/1991 | Epsztein . | |
| 5,155,416 | 10/1992 | Suzuki et al. . | |
| 5,164,632 | 11/1992 | Yoshida et al. . | |
| 5,227,691 | 7/1993 | Murai et al. . | |
| 5,235,244 | 8/1993 | Spindt . | |
| 5,315,207 | 5/1994 | Hoeberechts et al. . | |

FOREIGN PATENT DOCUMENTS

| | | |
|---|---|---|
| 0395158 | 10/1990 | European Pat. Off. . |
| 0523702 | 1/1993 | European Pat. Off. . |
| 0550335 | 7/1993 | European Pat. Off. . |
| 92/09095 | 5/1992 | WIPO . |

OTHER PUBLICATIONS

Spangenberg, *Vacuum Tube,* (McGraw–Hill), pp. 354–355, 1948.

*Primary Examiner*—Nimeshkumar D. Patel
*Attorney, Agent, or Firm*—Skjerven, Morrill, MacPherson, Franklin and Friel; Alan H. MacPherson; Ronald J. Meetin

[57] ABSTRACT

A gated field-emission structure contains a emitter electrode (46), an overlying electrically insulating layer (48, and one or more electron-emissive elements (52) situated in one or more apertures extending through the insulating layer. A patterned gate electrode (50) through which each electron-emissive element is exposed overlies the insulating layer. Focusing ridges (54) are situated on the insulating layer on opposite sides of the gate electrode. The focusing ridges, which normally extend to a considerably greater height than the gate electrode, cause emitted electrons to converge into a narrow band.

37 Claims, 6 Drawing Sheets

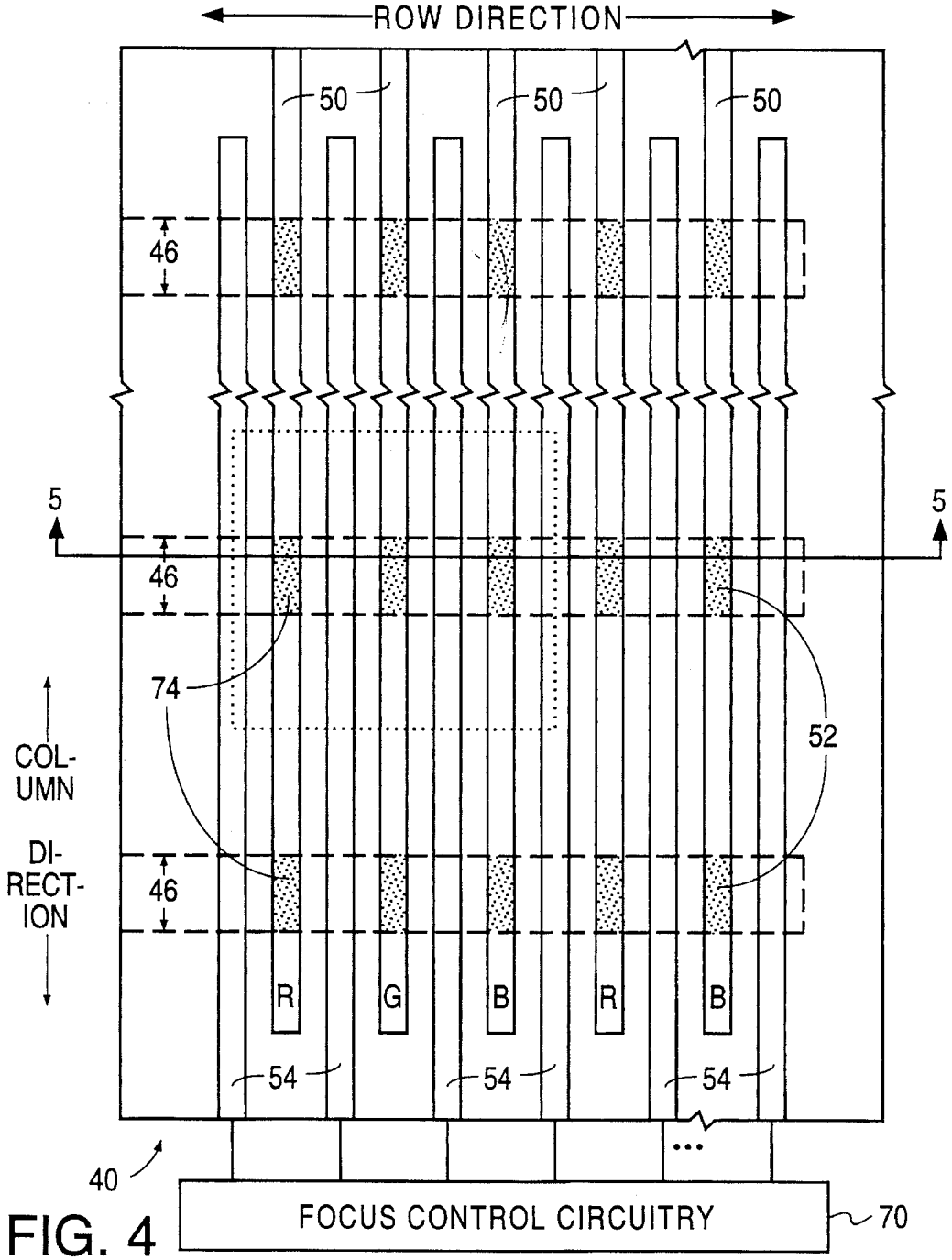
FIG. 4
FIG. 5
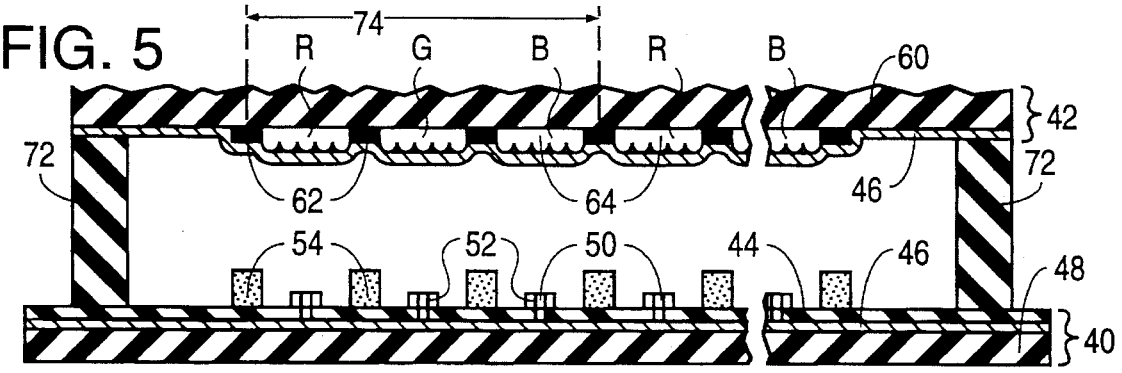

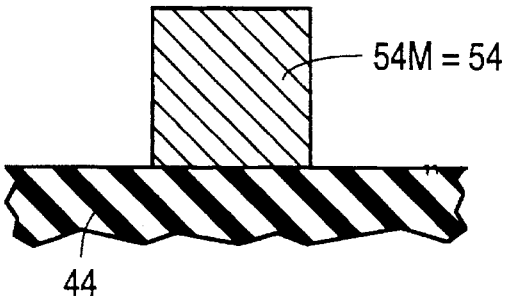
FIG. 8.1
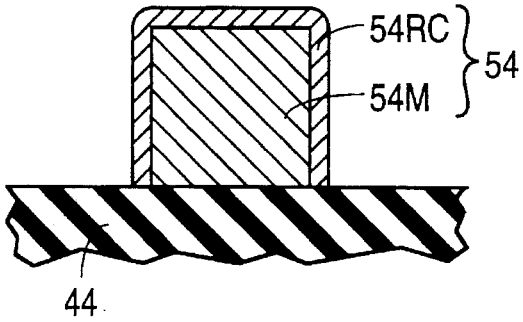
FIG. 8.2
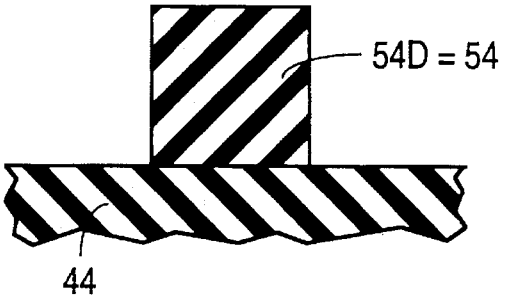
FIG. 8.3
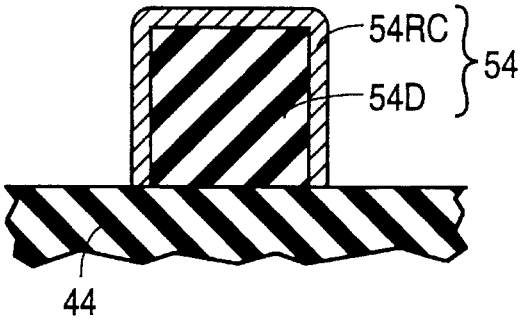
FIG. 8.4
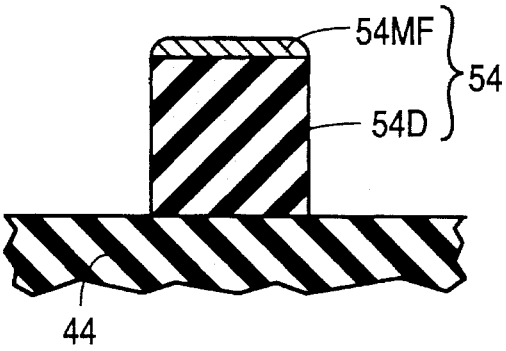
FIG. 8.5
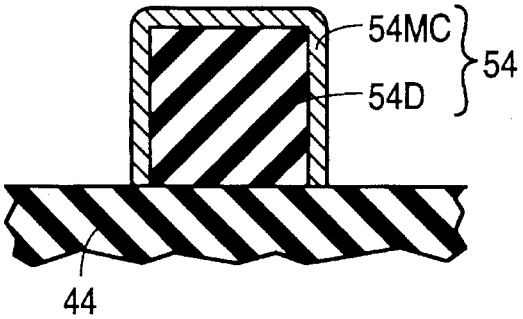
FIG. 8.6

FIELD EMITTER WITH FOCUSING RIDGES SITUATED TO SIDES OF GATE

FIELD OF USE

This invention relates to electron-emitting devices. More particularly, this invention relates to gated field-emission devices suitable for products such as cathode-ray tube ("CRT") displays of the flat-panel type.

BACKGROUND ART

A gated field-emission device (or field emitter) is an electronic device that emits electrons when subjected to an electric field of sufficient strength. The electrons are extracted from an electron-emissive element by a gate electrode, and are subsequently collected at an anode spaced apart from the electron-emissive element and gate electrode. An area field emitter contains a group, often a very large group, of individual electron-emissive elements distributed across a supporting structure. Area field emitters are employed in CRTs of flat-panel televisions.

Referring to the drawings, FIG. 1 generally illustrates part of a conventional flat-panel CRT containing a field-emission backplate (or baseplate) structure 10 and an electron-receiving faceplate structure 12. Backplate structure 10 commonly consists of an electrically insulating backplate 14, an emitter (or base) electrode 16, an electrically insulating layer 18, a patterned gate electrode 20, and a conical electron-emissive element 22 situated in an aperture through insulating layer 18. The tip of electron-emissive element 22 is exposed through a corresponding opening in gate electrode 20. Emitter electrode 16 and electron-emissive element 22 together constitute a cathode for the illustrated part of the CRT. Faceplate structure 12 is formed with an electrically insulating faceplate 24, an anode 26, and a coating of phosphors 28.

Anode 26 is maintained at a positive voltage relative to cathode 16/22. The anode voltage is typically 300–700 volts for a conventional spacing of 100–200 μm between structures 10 and 12. Because anode 26 is in contact with phosphors 28, the anode voltage is impressed on phosphors 28. When a suitable gate voltage is applied to gate electrode 20, electrons are emitted from electron-emissive element 22 at various values of off-normal emission angle θ. The emitted electrons follow parabolic trajectories indicated by lines 30 in FIG. 1 and impact on a target portion 28T of phosphors 28. The phosphors struck by the emitted electrons produce light of a selected color.

Phosphors 28 are part of a picture element ("pixel") that contains other phosphors (not shown) which emit light of different color than that produced by phosphors 28. Also, the pixel containing phosphors 28 adjoins one or more other pixels (not shown) in the CRT. If some of the electrons intended for phosphors 28 consistently strike other phosphors (in the same or another pixel), the image resolution and color purity are degraded.

The size of target phosphor portion 28T depends on the applied voltages and the geometric/dimensional characteristics of the CRT. Although the anode/phosphor voltage is typically 300–700 volts in the conventional flat-panel display of FIG. 1, power efficiency and phosphor lifetime are both considerably higher at a phosphor potential of 1,500–10,000 volts. However, increasing the anode/phosphor voltage to 1,500–10,000 volts in the CRT of FIG. 1 would require that the spacing between backplate structure 10 and faceplate structure 12 be much greater than the conventional value of 100–200 μm. Increasing the interstructure spacing to the value needed for a phosphor potential of 1,500–10,000 volts would, in turn, cause target phosphor portion 28T to become too large for a commercially viable flat-panel CRT display.

Focusing electrodes have been placed above the gate electrodes in field emitters to improve image resolution. For example, see U.S. Pat. Nos. 4,178,531, 5,070,282, and 5,235,244. Unfortunately, relatively complex processing at micrometer or submicrometer scale dimensions is usually needed to create a focusing electrode above the gate. It would be desirable to have a relatively simple gated field-emission structure that achieves high image resolution and color purity at high anode/phosphor voltage.

GENERAL DISCLOSURE OF THE INVENTION

The present invention furnishes a gated field-emission structure that utilizes focusing ridges situated to the sides of the gate for causing emitted electrons to converge into a narrow band. In flat-panel CRT applications of the present field-emission structure, high image resolution and color purity are achievable at a phosphor potential of 1,500–10,000 volts where power efficiency and phosphor lifetime are high. The focusing ridges can be fabricated in a straightforward manner without complex processing at micrometer or submicrometer scale dimensions. Accordingly, the invention provides a substantial advance over the prior art.

Specifically, the field-emission structure of the invention contains an emitter electrode, an overlying electrically insulating layer, and a set of one or more electron-emissive elements situated in one or more apertures extending through the insulating layer down to the emitter electrode. A gate electrode is situated over the insulating layer. One or more openings extend through the gate electrode to expose each electron-emissive element.

A pair of focusing ridges are situated over the insulating layer on opposite sides of the gate electrode. The focusing ridges are spaced laterally apart from the gate electrode. However, the ridges are close enough to the gate electrode to influence the trajectories of electrons emitted from each electron-emissive element. The ridges normally extend to a greater height than the gate electrode. The potentials of the ridges are controlled in such a way that a high percentage of the electron trajectories bend into a small band. Consequently, the image resolution and color purity are high when the field-emission structure is employed in a flat-panel CRT.

The invention is readily extended to an area field emitter. In doing so, the gate electrode becomes a plurality of gate lines extending over the insulating layer in one direction. Electron-emissive elements are situated in apertures through the insulating layer and are exposed through openings in the gate lines. A plurality of focusing ridges extend over the insulating layer in the same direction as the gate lines. The focusing ridges are interdigitated with the gate lines such that each gate line is situated between, and laterally spaced apart from, a pair of the focusing ridges. The emitter electrode becomes a plurality of emitter lines extending in a different direction than the gate lines and focusing ridges.

With proper design, the focusing ridges can handle electrons emitted at large off-normal angles. Large energy spread due to current-limiting resistors can also be handled by the ridges without significant loss in image resolution or color purity.

BRIEF DESCRIPTION OF THE DRAWINGS

FIG. 4 is a plan view representing the full extent of the backplate structure in the CRT of FIG. 2.

FIG. 5 is a cross-sectional structural view representing the full extent of the backplate and faceplate structures in the CRT of FIG. 2. The cross section of FIG. 5 is taken through plane 5—5 in FIG. 4.

FIG. 6 is a plan view representing a full-width part of the faceplate structure in the CRT of FIG. 2. Plane 5—5 in FIG. 6 likewise indicates the cross section through which FIG. 5 is taken.

FIGS. 8.1, 8.2, 8.3, 8.4, 8.5, and 8.6 are cross-sectional structural views of focusing ridges employable in the CRTs of FIGS. 2 and 7.

Like reference symbols are employed in the drawings and in the description of the preferred embodiments to represent the same or very similar item or items.

DESCRIPTION OF THE PREFERRED EMBODIMENTS

Figure 1:
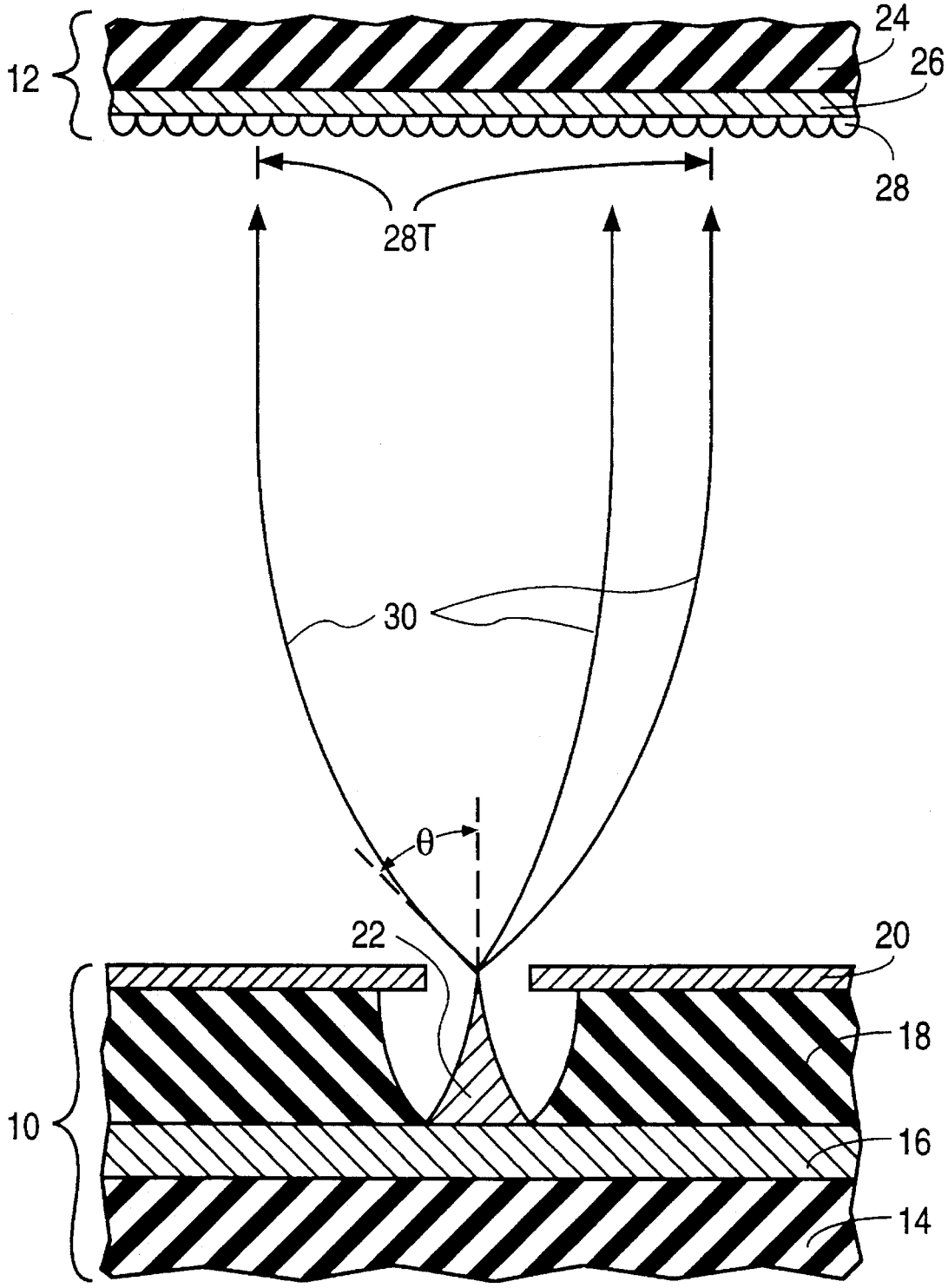
FIG. 1 PRIOR ART
FIG. 1 is a cross-section structural view of part of a prior art flat-panel CRT display that utilizes a gated field emitter.
Figure 2:
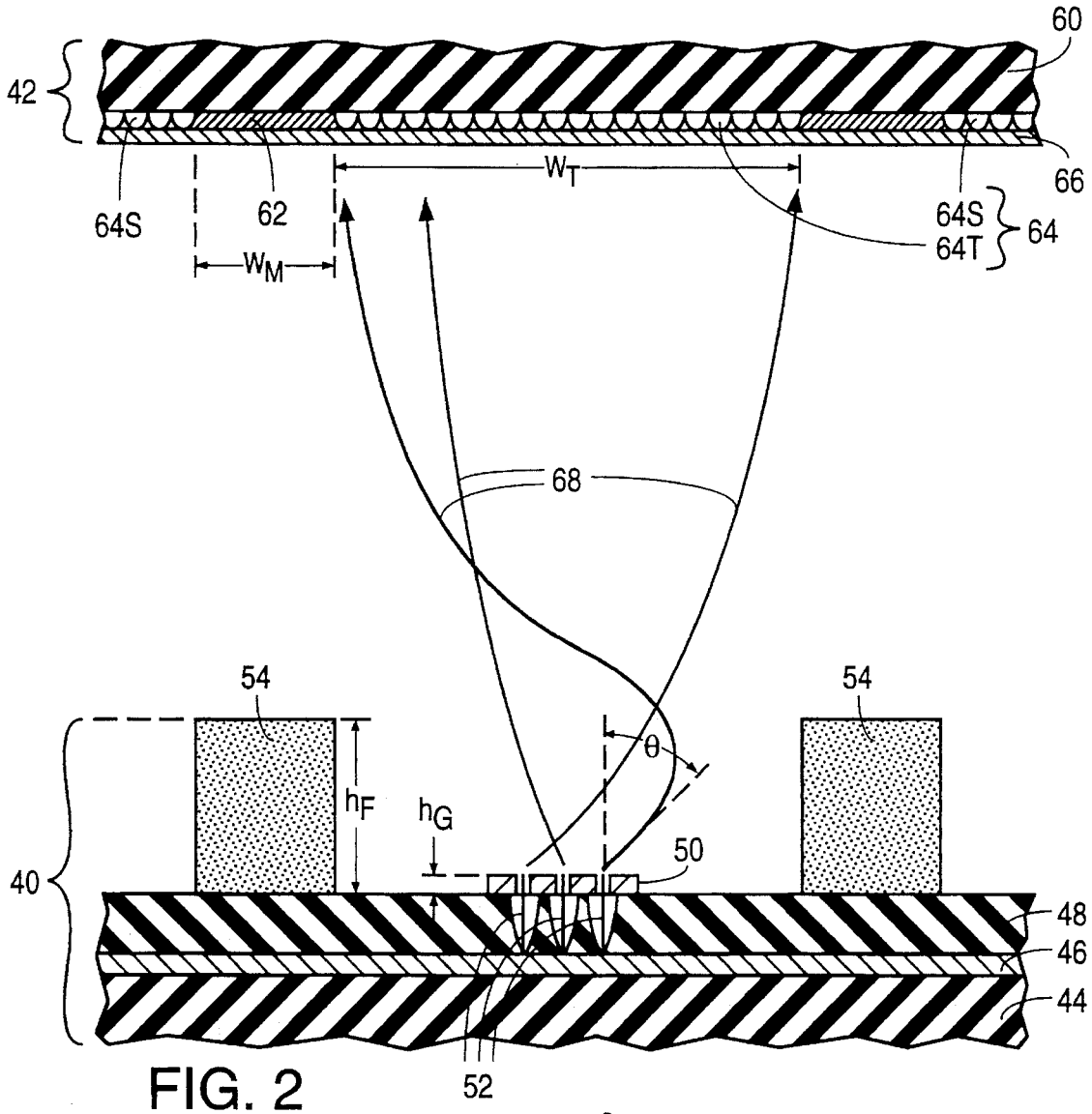
FIG. 2 is a cross-sectional structural view of part of a flat-panel CRT display that utilizes a gated field emitter having focusing ridges in accordance with the invention.
Figure 3:
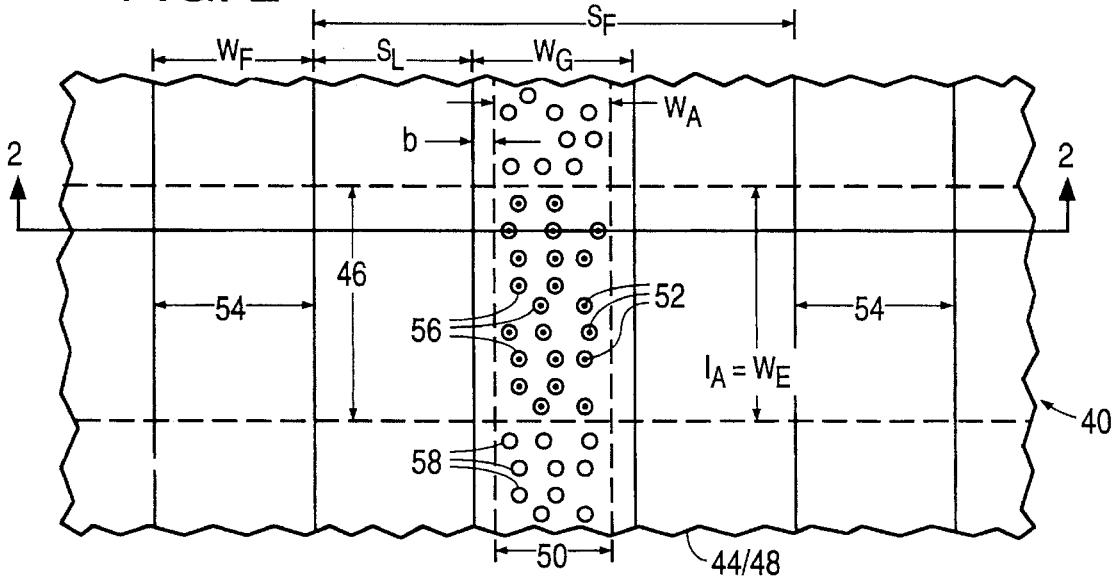
FIG. 3 is a plan view of the part of the backplate structure in the CRT of FIG. 2. The cross section of FIG. 2 is taken through plane 2—2 in FIG. 3.

FIG. 2 generally illustrates part of a flat-panel CRT that employs focusing ridges to improve image resolution and color purity in accordance with the invention. The CRT in FIG. 2 contains a field-emission backplate (or baseplate) structure 40 and an electron-receiving light-emissive faceplate structure 42. The interior surfaces of structures 40 and 42 face each other and are typically 0.1–2.5 mm apart. FIG. 3 depicts a top view of the portion of backplate structure 40 shown in FIG. 2.

The illustrated part of backplate structure 40 is formed with an electrically insulating backplate 44, a metallic emitter (or base) electrode 46, an electrically insulating layer 48, a metallic gate electrode 50, a multiplicity of electron-emissive elements 52, and a pair of focusing ridges 54. Backplate 44 is a flat plate typically consisting of glass, ceramic, or silicon. Emitter electrode 46 lies on the upper (or interior) surface of backplate 44 and is typically formed with molybdenum or chromium. Emitter electrode 46 is in the shape of a line whose width $w_E$ is typically 100 μm. Insulating layer 48 lies on emitter electrode 46 and on the laterally adjacent portion of backplate 44. Layer 48 typically consists of silicon dioxide. Components 44–48 typically have respective thicknesses of 1.0 mm, 0.5 μm, and 1.0 μm.

Gate electrode 50 lies on insulating layer 48. As indicated in FIG. 3, electrode 50 is in the shape of a line running perpendicular to emitter electrode 46. The width $w_G$ of gate electrode 50 is preferably 30 μm. Electrode typically 50 has an average height (or thickness) $h_G$ of 0.02–0.2 μm. Electrode 50 typically consists of a titanium-molybdenum composite.

Electron-emissive elements 52 extend through apertures in insulating layer 48 to contact emitter electrode 46. The tips (or upper ends) of electron-emissive elements 52 are exposed through corresponding openings 56 in gate electrode 50. Electron-emissive elements 52 can have various shapes. Although elements 52 are illustrated as needle-like elements in FIG. 2, they could (for example) be cones. The shape of elements 52 is not particularly material here as long as they have good electron-emissive characteristics.

Electron-emissive elements 52 are distributed across part or all of the portion of gate electrode 50 overlying emitter electrode 46. FIG. 3 illustrates the case in which elements 52 occupy a portion 50A of electrode 50 situated above electrode 46. The width $w_A$ of active emitter-area gate portion 50A in FIG. 3 is less than the width $w_G$ of electrode 50, while the length $l_A$ of active area portion 50A largely equals the width $w_E$ of emitter electrode 46. Also, active-area width $w_A$ in FIG. 3 is approximately centered on gate width $w_G$. Item b in FIG. 3 indicates the border spacing between one of the edges of electrode 50 and the corresponding longitudinal edge of portion 50A. The areal density of elements 52 is typically 1 element/$\mu m^2$. Elements 52 in combination with emitter electrode 46 form part of the cathode for the CRT.

Electron-emissive elements 52 can be manufactured according to various processes, including those described in Macaulay et al, U.S. patent application Ser. No. 08/118,490, filed 8 Sep. 1993, now U.S. Pat. No. 5,462,467 and Spindt et al, U.S. patent application Ser. No. 08/158,102, filed 24 Nov. 1993, now allowed. The contents of Ser. Nos. 08/118,490 and 08/158,102 are incorporated by reference herein.

Depending on how elements 52 are fabricated, openings 58 may extend through gate electrode 50 at locations where insulating layer 48 lies directly on backplate 44. Because openings 58 do not overlie emitter electrode 46, no electron-emissive elements are exposed through openings 58. If present, openings 58 therefore do not significantly affect device operation.

Focusing ridges 54 lie on insulating layer 48. As shown in FIG. 3, focusing ridges 54 are in the shape of bars situated on the opposite sides of, and running in the same direction as, gate electrode 50. Accordingly, ridges 54 also extend perpendicular to emitter electrode 46.

The width $w_F$ of each ridge 54 is approximately 25 μm. Ridges 54 are spaced equidistantly apart from gate electrode 50. The electrode-to-ridge spacing $s_L$ preferably is 25 μm. The total spacing $s_F$ between ridges 54 equals $w_G+2s_L$ and thus preferably is 80 μm.

Focusing ridges 54 normally extend to a considerably greater height above insulating layer 48 than gate electrode 50. Preferably, the average height $h_F$ of ridges 54 is at least ten times the average height $h_G$ of gate electrode 48. More preferably, $h_F$ is at least 100 times $h_G$. The ratio $h_F/s_F$ of ridge height to ridge spacing preferably is at least 0.1 and, more preferably, is at least 0.4. Typically, $h_F$ is 20–50 μm.

The illustrated part of faceplate structure 42 is formed with an electrically insulating faceplate 60, a pair of dark non-reflective lines 62, a patterned coating of phosphors 64, and a thin light-reflective layer 66. Faceplate 60 is a flat plate typically consisting of glass.

Dark lines 62 are situated on the lower (or interior) surface of faceplate 60 respectively opposite focusing ridges 54. Lines 62 are black or nearly black and, when struck by electrons, are substantially non-emissive of light relative to phosphors 64. The width $w_M$ of lines 62 is usually approximately the same as the width $w_F$ of ridges 54.

Phosphors 64 lie on the remaining portions of the lower surface of faceplate 60. A target portion 64T of phosphors 64 is situated between dark lines 62 opposite gate electrode 50. Target phosphor portion 64 has a width $w_T$ approximately equal to $s_F$. Portions 64S of phosphors 64 are situated on the other sides of dark lines 62.

Light-reflective layer 66 lies on phosphors 64 and dark lines 62 along their lower (or interior) surfaces. The thickness of layer 66 is sufficiently small, typically 50–100 nm, that nearly all electrons from electron-emissive elements 52 pass through layer 66 with little energy loss. Part of the light emitted by phosphors 64 is reflected by layer 66 through faceplate 60. Also, layer 66 consists of a metal, preferably aluminum, and thereby acts as the anode for the CRT.

Depending on the design of the CRT, focusing ridges 54 can be maintained at one voltage or at different voltages. Typically, the voltage on each ridge 54 is close to the voltage of emitter electrode 46. Light-reflective layer 66 and, consequently, phosphors 64 are maintained at a voltage of 1,500–10,000 volts, preferably 4,000–10,000 volts, relative to the emitter-electrode voltage. When electron-emissive elements 52 are activated, the gate voltage is typically 10–40 volts higher than the emitter voltage.

Electron-emissive elements 52 emit electrons at off-normal emission angle θ when gate electrode 50 is provided with a suitably positive voltage relative to the emitter-electrode voltage. The emitted electrons move towards phosphors 64 (and dark lines 62) along trajectories indicated by lines 68. When struck by these electrons, phosphors 64 emit light of selected color.

Focusing ridges 54 influence trajectories 68 in such a way that target phosphor portion 64T is struck by substantially all emitted electrons for which emission angle θ is less than or equal to a specified maximum value $\theta_{MAX}$. Typically, $\theta_{MAX}$ is 40°–60°. This provides increased image resolution and color purity at a phosphor voltage of 1,500–10,000 volts because the width $w_T$ of target portion 64T can be made smaller than the width of electron-target areas in otherwise similar conventional flat-panel CRTs.

Setting ridge height $h_F$ at a value much greater than gate height $h_G$ provides several benefits. The large negative focus voltage (typically several hundred volts) needed when $h_F$ equals $h_G$ is greatly reduced. The width $w_A$ of gate emitter area 50A can be increased, thereby enabling the areal density of electron-emissive elements 52 to be increased. Also, internal supports (not shown) are typically placed between backplate structure 40 and faceplate structure 42 to maintain a constant inter-structure spacing across the CRT. By making $h_F$ much greater than $h_G$, ridges 52 can provide contact sites along backplate structure 40 for the internal supports and thus avoid having the internal supports contact, and possibly damage, critical thin films such as gate electrode 50.

In the full implementation of the CRT of the invention, backplate structure 40 contains an array of emitter-electrode lines 46, gate-electrode lines 50, and focusing ridges 54. Turning to FIG. 4, it illustrates the characteristics of the full layout of the array formed by emitter lines 46, gate lines 50, and ridges 54 in structure 40. Gate lines 50 and ridges 54 are interdigitated with one another and run in a direction perpendicular to emitter lines 46. Gate lines 50 extend through the wall at one end of the array, while ridges 54 extend through the wall at the opposite end of the array.

Focusing ridges 54 are connected to focus control circuitry 70 as schematically shown in FIG. 4. Focus control circuitry 70 controls the potentials on ridges 54 in one of two general ways depending on CRT design.

One of the control techniques is to place focusing ridges 54 at the same voltage by connecting them all together. In this case, circuitry 70 simply controls the value of the single ridge voltage.

The other control technique is to divide ridges 54 into a number of equal-size consecutive groups. The first (e.g., left-most) electrodes in these groups of ridges 54 are connected together to receive one voltage whose value can vary. The second electrodes in the ridge groups are connected together to receive another variable voltage. When the group size is three or more, the third electrodes are connected together to receive a third variable voltage, and so on. Circuitry 70 then operates as a multiplexer for controlling the values of the ridge voltages in response to suitable control signals. This control technique is discussed further below in connection with FIGS. 5 and 6.

FIG. 5 depicts a full cross section of structures 40 and 42 when backplate structure 40 is laid out as shown in FIG. 4. As indicated in FIG. 5, an outer wall 72 is situated between structures 40 and 42 outside the active picture area. Outer wall 72 supports structures 40 and 42 and helps keep them separated from each other. The full CRT structure typically also includes the above-mentioned internal supports (again not shown) which ensure that the spacing between structures 40 and 42 is uniform across the entire active area of the CRT. The interior CRT pressure is typically below $10^{-7}$ torr.

Structures 40 and 42 are subdivided into an array of rows and columns of pixels. The boundaries of a typical pixel 74 are indicated by dotted lines in FIG. 4 and by corresponding boundary markers in FIG. 5. Each emitter line 46 is a row electrode for one of the rows of pixels. Each column of pixels has three of gate lines 50: (a) one for red (R), (b) a second for green (G), and (c) the third for blue (B). Each pixel column utilizes four of focusing ridges 54. Two of ridges 54 are internal to the pixel column. One or both of the remaining two are shared with the pixel(s) in the adjoining column(s).

Figure 6:
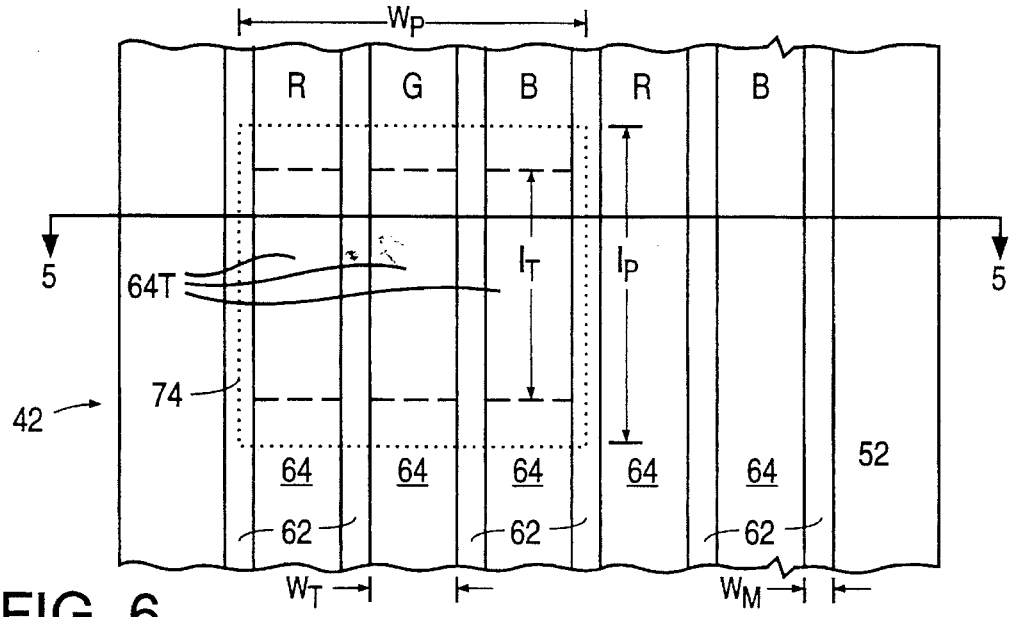

FIG. 6 illustrates the characteristics of a full-width portion of the layout of faceplate structure 42 in the CRT of FIG. 2. Structure 42 contains a group of dark lines 62 and a group of stripes of phosphor 64 arranged in an alternating pattern. Dark lines 62 constitute a "black matrix". As indicated by typical pixel 74 in FIG. 6, each column of pixels contains a stripe of phosphors 64 that emit red light, a stripe of phosphors 64 that emit green light, and a stripe of phosphors 64 that emit blue light.

Pixel 74 has a width $w_P$ and a length $l_P$ normally equal to $w_P$. From an examination of FIGS. 2–6, $w_P$ equals $3(w_M+w_T)$ which, in turn, equals $3(w_F+s_F)$. Preferably, $w_P$ and $l_P$ are both 315–320 μm.

Focusing ridges 54 in the full implementation of FIGS. 4–6 improve the image resolution and color purity in the row direction (i.e., along the rows of pixels) in the manner discussed above in connection with FIGS. 2 and 3. The image resolution is less critical in the column direction (i.e., along the columns of pixels) because the length $l_T$ of the phosphor target 64T, while being somewhat greater than the length $l_A$ of active area portion 50A of each gate line 50, is considerably less than the length $l_P$ of each pixel. Preferably, $l_T$ is approximately 200 μm. Consequently, $l_T$ is more than 100 μm less than $l_P$. Also, the color purity is not a problem in the column direction because the color is the same in going along each phosphor stripe 64 in a pixel column.

When the second of the above-mentioned control techniques (i.e., the one in which focus control circuitry 70 functions as a multiplexer) is utilized in the full CRT of FIGS. 4–6, focusing ridges 54 situated directly to the left of "red" gate lines 50 receive one ridge voltage. Ridges 54 located directly to the left of "green" gate lines 50 receive another ridge voltage. Finally, ridges 54 situated directly to the left of "blue" gate lines 50 receive a third ridge voltage.

Focus control circuitry 70 controls the values of the three ridge voltages in such a way that electrons from field emitters 52 extending through gate lines 50 for one of the three colors are directed toward corresponding target phosphors 64T of that color. Electrons from emitters 52 extending through gate lines 50 for the other two colors are simultaneously collected on ridges 54 situated directly between those lines 50. By so utilizing ridges 54 to perform both an electron-focusing function and an electron-collecting function, only electrons intended to cause phosphors 64 to emit light of one color are provided from emitters 52 at a time. To achieve all three colors, the CRT is operated frame sequentially.

Figure 7:
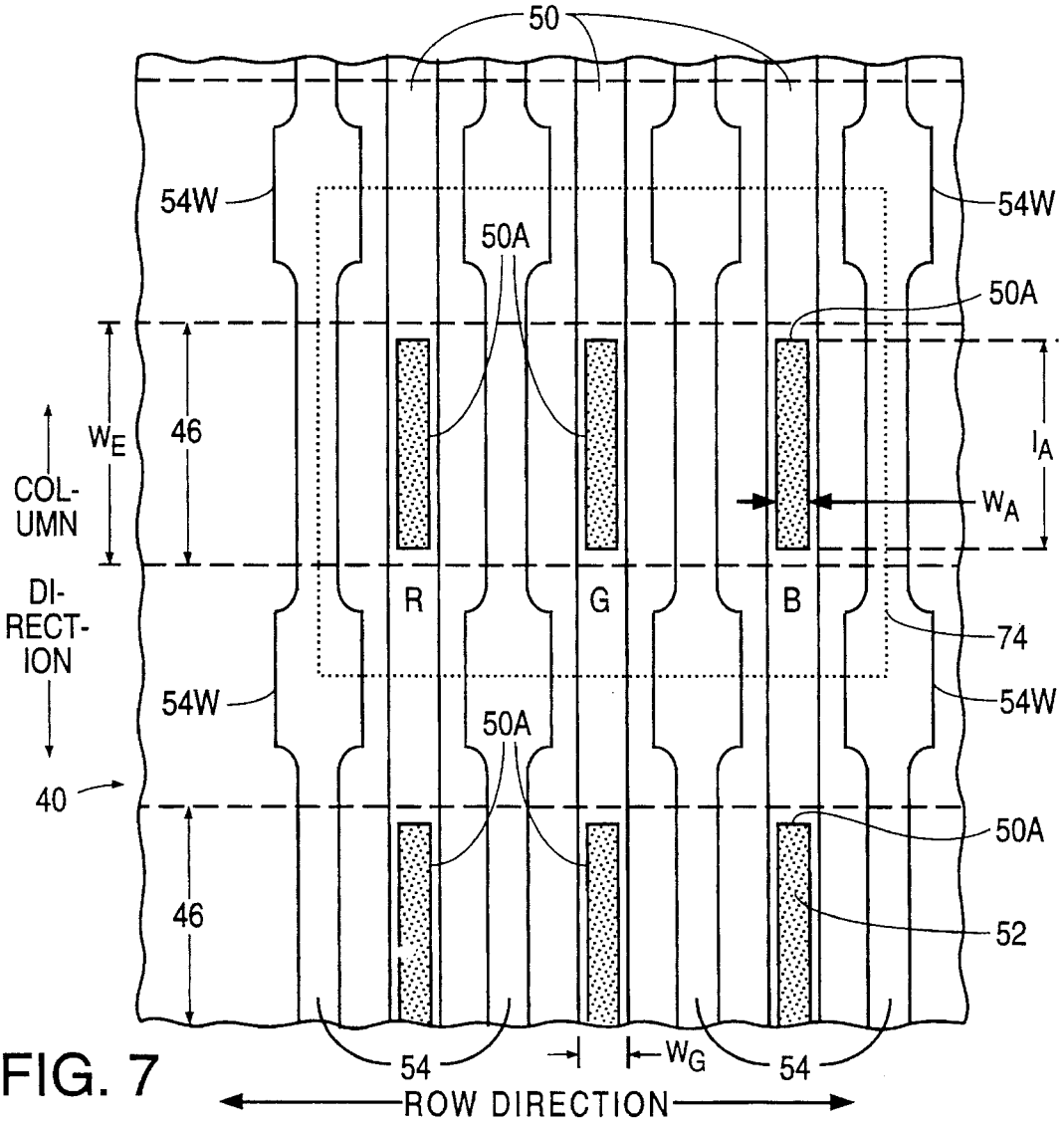
FIG. 7 is a plan view of part of an alternative backplate structure for a flat-panel CRT that utilizes focusing ridges in accordance with the invention.

Focusing ridges 54 can be configured to improve image resolution in the column direction. Turning to FIG. 7, it depicts an alternative layout of a portion of backplate structure 40 containing a full pixel 74. In this alternative, ridges 54 have widened portions 54W situated between emitter lines 46. Widened portions 54W cause electrons emitted from electron-emissive elements 52 to converge closer to the vertical centers of phosphor targets 64T. FIG. 7 also shows that elements 52 can be located in portions 50A of gate lines 50 where (a) the width $w_A$ of each portion 50A is less than the width $w_G$ of gate lines 50 and/or (b) the length $l_A$ of each portion 50A is less than the width $w_E$ of emitter lines 46.

Focusing ridges 54 can be formed with a number of different types of materials ranging from electrical insulators to metals, and can be configured in a variety of ways. FIGS. 8.1–8.6 depict typical structures for ridges 54.

In FIG. 8.1, each focusing ridge 54 consists of a metal bar 54M. In FIG. 8.2, each ridge 54 is formed with metal bar 54M and a highly resistive electrically conductive coating 54RC.

FIG. 8.3 illustrates an example in which each focusing ridge 54 consists of a dielectric bar 54D. In FIG. 8.4, each ridge 54 is formed with dielectric bar 54D and resistive coating 54RC. In FIG. 8.5, each ridge 54 consists of dielectric bar 54D and a metal film 54MF on top of dielectric bar 54D. In FIG. 8.6, each ridge 54 is formed with dielectric bar 54D and a metal coating 54MC.

In manufacturing the CRT of the invention, components 44–52 in backplate structure 40 can be fabricated in a conventional manner. Components 44–52 can, as indicated above, also be made according to the techniques described in U.S. patent applications Ser. Nos. 08/118,490 and 08/158,102, cited above.

In an embodiment where focusing ridges 54 utilize metal bars such as in FIGS. 8.1 and 8.2, thin bottom portions of the metal bars can be created from the same metal as gate lines 50 by depositing a layer of appropriate metal on insulating layer 48 and then patterning the metal using a suitable photoresist mask to simultaneously create gate lines 50 and the bottom portions of the metal bars. The remainders of the metal bars can be electroplated on the bottom portions using a photoresist mask to cover gate lines 50. Alternatively, the remainders of the metal bars can be created by placing a suitable pre-patterned metal screen over the bottom portions of the metal bars. The screen wires that form the remainders of the metal bars can be square or circular in cross section.

Components 60–64 in backplate structure 42 can be fabricated in a conventional manner. Alternatively, components 60–64 can be manufactured in accordance with the techniques described in Curtin et al, commonly owned U.S. patent application Ser. No. 08/188,856, filed 31 Jan. 1994 contents of which are incorporated by reference herein.

The CRT preferably contains the above-mentioned internal supports (not shown) for supporting the CRT against atmospheric pressure and maintaining a uniform spacing between structures 40 and 42. The internal supports can be fabricated in a conventional manner, in accordance with Fahlen et al, commonly owned U.S. patent application Ser. No. 08/012,542, filed 1 Feb. 1993, or in accordance with Fahlen et al, commonly owned U.S. patent application Ser. No. 08/188,857 filed 31 Jan. 1994 "Structure and The contents of these two patent applications are incorporated by reference herein. Outer wall 72 is provided to complete the basic CRT fabrication.

While the invention has been described with reference to particular embodiments, this description is solely for the purpose of illustration and is not to be construed as limiting the scope of the invention claimed below. For example, gate lines 50 could be extended through the walls at both ends of the array by providing suitable cross-over connections for focusing ridges 54. Pre-formed screen wires that implement ridges 54 could have cross sections other than square or circular.

An anode that directly adjoins faceplate 60 could be utilized in place of, or in conjunction with, light-reflective layer 66. Typically, such an anode would be used when the anode/phosphor voltage is 1,500–4,000 volts.

Elements other than phosphors 64 could be utilized as electron-receptive light-emissive sites in faceplate structure 42. Instead of being flat, backplate 44 and faceplate 60 could be curved.

Each gate line 50 could be employed with three (consecutive) phosphor stripes 64. The CRT could then be operated using focusing ridges 54 to deflect and focus electrons onto each of the three target portions 64 under the control of focus control circuitry 70.

Figure 9:
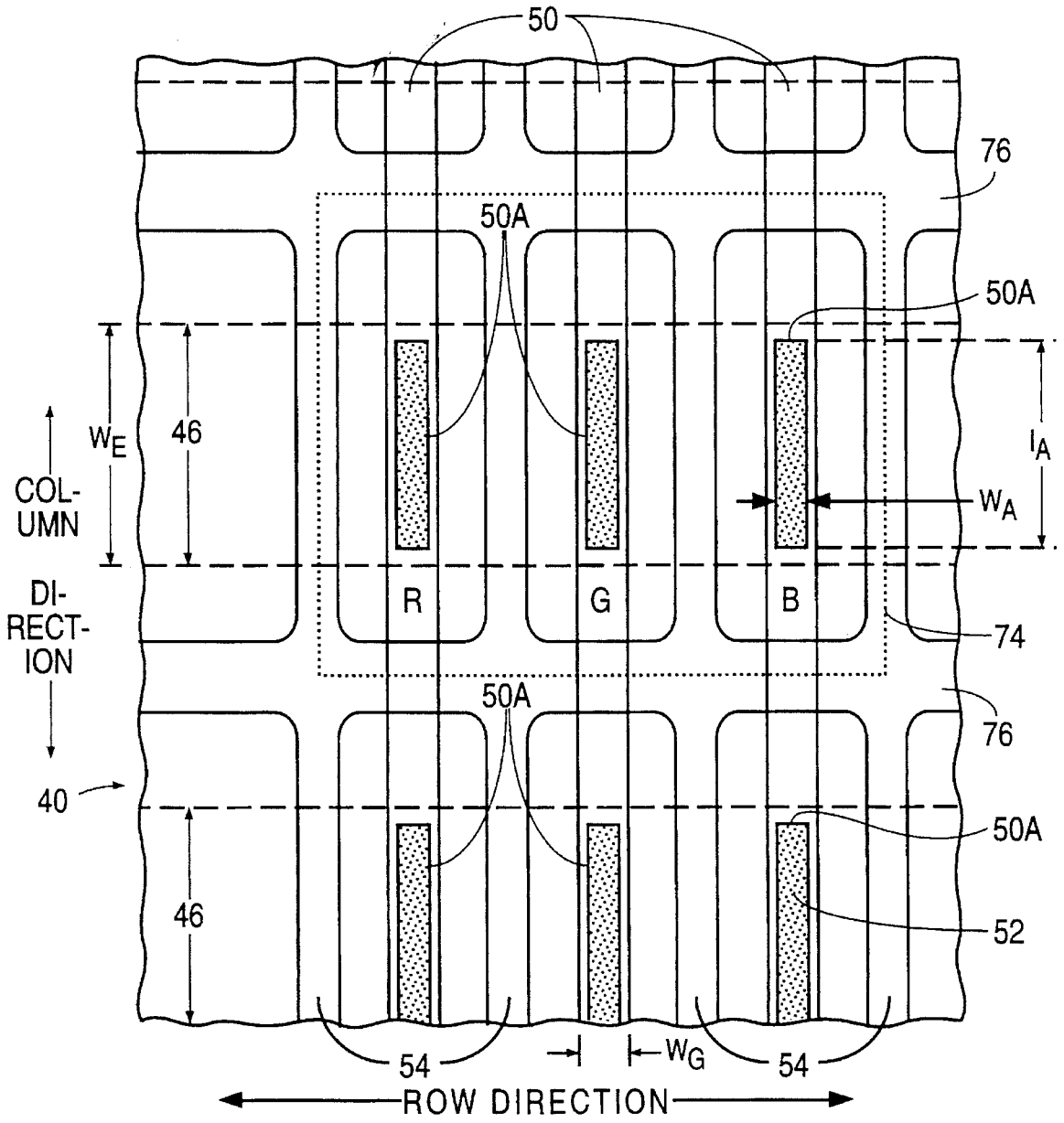
FIG. 9 is a plan view of part of an alternative backplate structure for a flat-panel CRT that employs crossing groups of focusing ridges in accordance with the invention.

If additional focusing is needed in the column direction beyond the extra column-direction focusing provided in the alternative layout of FIG. 7, widened portions 54W of adjacent ridges 54 could be connected together to form focusing ridges extending in the row direction. In that case, the focusing ridges extending in the row direction would cross over emitter lines 50 and would be separated from them by an additional dielectric layer. FIG. 9 illustrates such an embodiment of the invention using the topography of FIG. 7 except that widened portions 54W are replaced with additional focusing ridges 76 that extend perpendicularly to, and meet, focusing ridges 54. Various modifications and applications may thus be made by those skilled in the art without departing from the true scope and spirit of the invention as defined in the appended claims.

We claim:

1. A structure comprising:

an emitter electrode;

an electrically insulating layer situated over the emitter electrode;

a set of at least one electron-emissive element situated in at least one aperture extending through the insulating layer down to the emitter electrode such that each electron-emissive element contacts the emitter electrode;

a gate electrode situated over the insulating layer, at least one opening extending through the gate electrode to expose each electron-emissive element; and a pair of focusing ridges situated over the insulating layer on opposite sides of, and spaced laterally apart from, the gate electrode, the focusing ridges being sufficiently close to the gate electrode to control trajectories of electrons emitted from each electron-emissive element, the focusing ridges extending to an average height above the insulating layer of at least ten times the average height of the gate electrode above the insulating layer.

2. A structure as in claim 1 wherein the average height of the focusing ridges above the insulating layer is at least one tenth of the spacing between the focusing ridges.

3. A structure as in claim 1 further including an electrically conductive section situated above, and spaced apart from, the gate electrode and focusing ridges, the conductive section having an electron-receptive site for receiving electrons emitted from each electron-emissive element.

4. A structure as in claim 3 wherein the electron-receptive site emits light when struck by electrons from each electron-emissive element.

5. A structure as in claim 1 wherein the set of at least one electron-emissive element comprises a multiplicity of electron-emissive elements, each situated in a different aperture extending through the insulating layer.

6. A structure as in claim 1 wherein each ridge comprises a metal bar.

7. A structure as in claim 6 wherein each ridge includes a highly resistive electrically conductive coating over top and side surfaces of the metal bar.

8. A structure as in claim 1 wherein each ridge comprises a dielectric bar.

9. A structure as in claim 8 wherein each ridge includes a metal film on top of the dielectric bar.

10. A structure as in claim 8 wherein each ridge includes a metal coating over top and side surfaces of the dielectric bar.

11. A structure as in claim 8 wherein each ridge includes a highly resistive electrically conductive coating over top and side surfaces of the dielectric bar.

12. A structure comprising:

an emitter electrode;

an electrically insulating layer situated over the emitter electrode;

an array of laterally separated sets of electron-emissive elements, each set comprising at least one electron-emissive element situated in at least one opening extending through the insulating layer down to the emitter electrode such that each electron-emissive element contacts the emitter electrode;

a plurality of electrically conductive gate lines extending over the insulating layer largely in a primary direction, openings extending through the gate lines to expose the electron-emissive elements; and a plurality of focusing ridges extending over the insulating layer largely in the primary direction, the focusing ridges being interdigitated with the gate lines such that each gate line is largely situated between, and laterally spaced apart from, a different consecutive pair of the focusing ridges, the focusing ridges extending to an average height above the insulating layer of at least ten times the average height of the gate lines above the insulating layer.

13. A structure as in claim 12 wherein the average height of the focusing ridges above the insulating layer is at least one tenth of the average spacing between the focusing ridges.

14. A structure as in claim 12 further including:

an electrically conductive section situated above, and spaced apart from, the gate lines and focusing ridges, the conductive section comprising an array of electron-receptive sites respectively corresponding to the sets of electron-emissive elements for receiving electrons emitted from the electron-emissive elements; and a support section that keeps the conductive section spaced apart from the gate lines and focusing ridges.

15. A structure as in claim 14 wherein the electron-receptive sites emit light when struck by electrons from the electron-emissive elements.

16. A structure as in claim 14 wherein the emitter electrode comprises a plurality of emitter lines extending in a further direction substantially different from the primary direction.

17. A structure as in claim 16 wherein the primary and further directions are laterally orthogonal to one another.

18. A structure as in claim 12 wherein the ridges are electrically conductive.

19. A structure as in claim 18 further including means for electrically interconnecting the focusing ridges in order to apply substantially the same voltage to all of them.

20. A structure as in claim 18 further including means for simultaneously providing different voltages to different ones of the focusing ridges.

21. A structure as in claim 12 further including an additional plurality of focusing ridges situated over the insulating layer, extending in a further direction substantially different from the primary direction, meeting the first-mentioned focusing ridges, and crossing over the gate lines.

22. A structure comprising:

an emitter electrode;

an electrically insulating layer situated over the emitter electrode;

an array of laterally separated sets of electron-emissive elements, each set comprising at least one electron-emissive element situated in at least one opening extending through the insulating layer down to the emitter electrode such that each electron-emissive element contacts the emitter electrode;

a plurality of electrically conductive gate lines extending over the insulating layer largely in a primary direction, openings extending through the gate lines to expose the electron-emissive elements;

a plurality of first focusing ridges extending over the insulating layer largely in the primary direction, the first focusing ridges being interdigitated with the gate lines such that each gate line is largely situated between, and laterally spaced apart from, a different consecutive pair of the first focusing ridges, the first focusing ridges extending to an average height above the insulating layer of at least ten times the average height of the gate lines above the insulating layer; and a plurality of second focusing ridges extending over the insulating layer in a further direction substantially different from the primary direction, meeting the first focusing ridges and crossing over the gate lines.

23. A structure as in claim 22 further including;

an electrically conductive section situated above, and spaced apart from, the gate lines and focusing ridges, the conductive section comprising an array of electron-receptive sites respectively corresponding to the sets of electron-emissive elements for receiving electrons emitted from the electron-emissive elements; and a support section that keeps the conductive section spaced apart from the gate lines and focusing ridges.

24. A structure as in claim 23 wherein the electron-receptive sites emit light when struck by electrons from the electron-emissive elements.

25. A structure as in claim 23 wherein the emitter electrode comprises a plurality of emitter lines extending in the further direction.

26. A structure as in claim 25 wherein the primary and further directions are laterally orthogonal to one another.

27. A structure as in claim 22 wherein the ridges are electrically conductive.

28. A structure comprising:

an emitter electrode;

an electrically insulating layer situated over the emitter electrode;

a set of at least one electron-emissive element situated in at least one aperture extending through the insulating layer down to the emitter electrode such that each electron-emissive element contacts the emitter electrode;

a gate electrode situated over the insulating layer, at least one opening extending through the gate electrode to expose each electron-emissive element;

a pair of first focusing ridges situated over the insulating layer on opposite sides of, and spaced laterally apart from, the gate electrode, the first focusing ridges being sufficiently close to the gate electrode to control trajectories of electrons emitted from each electron-emissive element, the first focusing ridges extending to an average height above the insulating layer of at least ten times the average height of the gate electrode above the insulating layer; and a pair of second focusing ridges situated over the insulating layer, meeting the first focusing ridges, and crossing over the gate electrode.

29. A structure as in claim 28 further including an electrically conductive section situated above, and spaced apart from, the gate electrode and focusing ridges, the conductive section having an electron-receptive site for receiving electrons emitted from each electron-emissive element.

30. A structure as in claim 29 wherein the electron-receptive site emits light when struck by electrons from each electron-emissive element.

31. A structure as in claim 28 wherein the set of at least one electron-emissive element comprises a multiplicity of electron-emissive elements, each situated in a different aperture extending through the insulating layer.

32. A structure as in claim 28 wherein each ridge comprises a metal bar.

33. A structure as in claim 32 wherein each ridge includes a highly resistive electrically conductive coating over top and side surfaces of the metal bar.

34. A structure as in claim 28 wherein each ridge comprises a dielectric bar.

35. A structure as in claim 34 wherein each ridge includes a metal film on top of the dielectric bar.

36. A structure as in claim 34 wherein each ridge includes a metal coating over top and side surfaces of the dielectric bar.

37. A structure as in claim 34 wherein each ridge includes a highly resistive electrically conductive coating over top and side surfaces of the dielectric bar.

* * * * *